US005698508A

United States Patent [19]

Nomura et al.

[11] Patent Number: 5,698,508

[45] Date of Patent: Dec. 16, 1997

[54] POWDERED DETERGENT COMPOSITION

[75] Inventors: Masafumi Nomura; Atsushi Tanaka, both of Wakayama; Eiichi Hoshino, Tochigi, all of Japan

[73] Assignee: Kao Corporation, Tokyo, Japan

[21] Appl. No.: 577,214

[22] Filed: Dec. 22, 1995

[30] Foreign Application Priority Data

Dec. 22, 1994 [JP] Japan ..... 6-320544

[51] Int. Cl.[6] ..... C11D 1/12; C11D 1/722; C11D 3/08

[52] U.S. Cl. ..... 510/320; 510/323; 510/392; 510/507; 510/307; 510/475; 510/498

[58] Field of Search ..... 510/320, 323, 510/392, 507, 509, 498, 475

[56] References Cited

U.S. PATENT DOCUMENTS

| | | | |
|---|---|---|---|
| 4,933,287 | 6/1990 | Farin et al. | 252/198 |
| 4,992,198 | 2/1991 | Nebashi et al. | 252/174.11 |
| 5,078,898 | 1/1992 | Jars | 252/174.12 |
| 5,133,893 | 7/1992 | Thom et al. | 252/99 |
| 5,158,700 | 10/1992 | Sotoya et al. | 252/186.38 |
| 5,292,448 | 3/1994 | Klugkist | 252/174.12 |
| 5,312,561 | 5/1994 | Hoshino et al. | 252/174.12 |
| 5,468,516 | 11/1995 | Yamashita et al. | 427/180 |
| 5,529,715 | 6/1996 | Kuroda et al. | 252/135 |

FOREIGN PATENT DOCUMENTS

| | | |
|---|---|---|
| 341999 | 11/1989 | European Pat. Off. . |
| 381397 | 8/1990 | European Pat. Off. . |

OTHER PUBLICATIONS

Analytical Chemistry, vol. 58, pp. 2380–2383 (1986).

*Primary Examiner*—Paul Lieberman
*Assistant Examiner*—Kery A. Fries
*Attorney, Agent, or Firm*—Birch, Stewart, Kolasch & Birch, LLP

[57] ABSTRACT

A powdered detergent composition comprising a nonionic surfactant as the main surfactant, which comprises (a) a polyoxyethylene alkyl ether, wherein the alkyl group has 10 to 20 carbon atoms on the average and the average molar number of ethylene oxide added is 5 to 15, in an amount of 12 to 35% by weight based on the total weight of the composition, (b) a lipolytic enzyme in such an amount that the lipolytic activity per gram of component (a) would be 0.1 to 500 LU, (c) an anionic surfactant in an amount of 1.0 to 7.0% by weight based on the total weight of the composition and (d) an alkaline material in an amount of 5 to 35% by weight based on the total weight of the composition, and of which a 0.1% by weight aqueous solution has a pH exceeding 9.0, is excellent in detergency on oily soils such as subum soil.

4 Claims, No Drawings

POWDERED DETERGENT COMPOSITION

BACKGROUND OF THE INVENTION

1. Field of the Invention

The present invention relates to a detergent composition for clothes which contains a lipolytic enzyme capable of effectively removing sebum soil, and which comprises a nonionic surfactant as the main ingredient.

2. Description of the Related Art

Detergent compositions each containing an enzyme have been employed for a long time because of their excellent detergency. Examples of the enzymes usually used as adjuvants for detergents in such detergent compositions include a protease, an amylase, a cellulase and a lipase.

An example of the detergent compositions each containing an enzyme is a detergent composition containing 10 to 35% by weight of an anionic surfactant and 0 to 10% by weight of a nonionic surfactant, which is characterized by further containing "Lipolase" (a registered trade name of Novo Nordisk Bioindustry Ltd.) as disclosed in European Patent Publication-A No. 381,397 (Applicant: Unilever PLC, published on Aug. 8, 1990). While U.S. Pat. No. 5,292,448 (Assignee: Unilever PLC, et. al., published on Mar. 8, 1994) discloses that when a detergent composition comprising an anionic surfactant and a lipase further contains a specific nonionic surfactant selected from the group consisting of an alkylene oxide adduct of an aliphatic alcohol having at least 10 carbon atoms with less than 5 mol, on the average, of an oxyalkylene group(s), an alkylene oxide adduct of fatty acid having at least 10 carbon atoms with less than 5 mol, on the average, of an oxyalkylene group(s), an alkylene oxide adduct of a fatty acid ester having at least 10 carbon atoms with less than 5 mol, on the average, of an oxyalkylene group(s), an alkylene oxide adduct of a fatty acid amide having at least 10 carbon atoms with less than 5 mol, on the average, of an oxyalkylene group(s), and an alkylene oxide adduct of an aliphatic amine having at least 10 carbon atoms with less than 5 mol, on average, of an oxyalkylene group(s) in an amount of not more than the same percentage by weight as the percentage by weight of the anionic surfactant, the detergency is improved.

However, such detergent compositions as disclosed in the above-described patent gazettes and containing an anionic surfactant in a relatively large amount as compared with the nonionic surfactant is insufficient in its detergency to sebum soil.

DISCLOSURE OF THE INVENTION

Summary of the Invention

The present inventors have extensively studied for the purpose of developing a detergent composition for clothes capable of effectively removing sebum soil which has been difficultly removed in the prior art. As the result of the studies, the present inventors have found that a detergent composition for clothes comprising a nonionic surfactant as the main ingredient, a lipolytic enzyme in a specific ratio to the nonionic surfactant, and an anionic surfactant in a limited amount as compared with that of the nonionic surfactant exhibits an enhanced detergency to sebum soil, and that the components other than an enzyme(s) contained in the detergent composition have no bad influence on the activity(s) of enzyme(s) contained in the detergent composition, including the lipolytic enzyme. The present invention has been completed on the basis of this finding.

Thus, the present invention relates a powdered detergent composition comprising (a) a polyoxyethylene alkyl ether, wherein the alkyl group has 10 to 20 carbon atoms on the average and the average molar number of ethylene oxide added is 5 to 15, in an amount of 12 to 35% by weight based on the total weight of the composition, (b) a lipolytic enzyme in such an amount that the lipolytic activity per gram of component (a) would be 0.1 to 500 LU, (c) an anionic surfactant in an amount of 1.0 to 7.0% by weight based on the total weight of the composition and (d) an alkaline material in an amount of 5 to 35% by weight based on the total weight of the composition, wherein a 0.1% by weight aqueous solution of the composition has a pH exceeding 9.0.

In other words, the present invention relates to a powdered detergent composition comprising a nonionic surfactant as the main ingredient which contains the following components (a), (b), (c) and (d):

(a) a polyoxyethylene alkyl ether in which the average carbon atom number of the alkyl group is from 10 to 20 and the average molar number of ethylene oxide added is from 5 to 15
12 to 35% by weight, (b) a lipolytic enzyme in which its lipolytic activity per gram of component (a) is from 0.1 to 500 (LU/g), (c) an anionic surfactant
1.0 to 7.0% by weight, and (d) an alkaline material
5 to 35% by weight, in which the pH of a 0.1% by weight aqueous solution thereof is exceeding 9.0.

The anionic surfactant (c) is preferably an alkylbenzenesulfonate.

The powdered detergent composition preferably comprises, further, a crystalline aluminosilicate having an average primary particle diameter of 0.1 to 10 μm in an amount of 10 to 60% by weight based on the total weight of the composition.

Thus, the present invention proposes, as the most effective formulation of a lipase-containing detergent, a formulation wherein a nonionic surfactant is the main base and the amount of an anionic surfactant is thus limited. According to the present invention, a detergent composition for clothes having a remarkably improved detergency to soil composed of fatty components is obtained.

Further scope and applicability of the present invention will become apparent from the detailed description and examples given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description and examples.

DETAILED DESCRIPTION OF THE INVENTION

The nonionic surfactant (a) used in the present invention is a polyoxyethylene alkyl ether wherein the alkyl group has 10 to 20, preferably 12 to 18 and particularly preferably 12 to 14 carbon atoms on the average, and the average molar number of ethylene oxide added is 5 to 15, preferably 6 to 12 and particularly preferably 6 to 10. The polyoxyethylene alkyl ether is obtained by adding ethylene oxide to a linear or branched, primary or secondary alcohol by conventional synthesis methods.

The polyoxyethylene alkyl ether is generally a mixture comprising adducts having molar addition numbers of ethylene oxide which are different from one another. That is, the mixture has a definite distribution of the molar addition numbers of ethylene oxide, and contains also adducts each having a low molar addition number of ethylene oxide and the starting alcohol in a large amount. In the present invention, a mixture (polyoxyethylene alkyl ether) containing adducts each having a molar addition number of ethylene oxide of 0 to 3 mol in an amount of preferably not more than 35% by weight, still more preferably not more than 25% by weight, may be used.

The detergent composition according to the present invention comprises component (a) in an amount of 12 to 35% by weight, preferably 15 to 30% by weight, based on the total weight of the composition. When the amount of component (a) is within the range of from 12 to 35% by weight, sufficient detergency can be attained.

In the present invention, at least one nonionic surfactant (s) other than component (a), such as a polyoxyethylene alkylphenyl ether, a polyoxyethylene sorbitan/fatty acid ester, a polyoxyethylene sorbitol/fatty acid ester, a polyethylene glycol/fatty acid ester, a polyoxyethylene polyoxypropylene alkyl ether, a polyoxyethylene castor oil, a polyoxyethylene hardened castor oil, a polyoxyethylene alkylamine, a glycerol/fatty acid ester, a higher fatty acid alkanolamide, an alkyl glucoside and an alkylamine oxide, may also be used in combination with component (a).

The lipolytic enzyme (b) in the present invention is usually provided in the form of granules. The lipolytic enzyme (b) according to the present invention has a optimum pH preferably in an alkaline range, still more preferably in the range of pH 8 to 11, and particularly preferred is an alkaline lipase. Examples of the alkaline lipases include Lipolase 100T derived from *Humicola sp.* (manufactured by Novo Nordisk Bioindustry Ltd.), and LIPOMAX (manufactured by GIST Brocade) and LUMAFAST 2000G (manufactured by GENENCOR International Inc.) derived from *Pseudomonas sp.* Lipolase 100T derived from *Humicola sp.* (manufactured by Novo Nordisk Bioindustry Ltd.) is particularly preferably used in the present invention.

In the present invention, the lipolytic enzyme (b) is used in such an amount that the lipase activity per gram of component (a) incorporated would be 0.1 to 500 LU. Namely, when q (% by weight) of the lipolytic enzyme having a specific activity of P (LU/g-enzyme) as determined by a method which will be described below is incorporated into the detergent composition and the amount of component (a) incorporated into the detergent composition is r (% by weight), the value calculated according to the following formula must be in the range of from 0.1 to 500 LU/g-component (a):

$$\frac{P\ (LU/g\text{-}enzyme) \times q\ (g)/100}{r\ (g)/100} = \frac{P \times q\ (LU)}{r\ (g)}.$$

When the activity of the lipolytic enzyme (b) per gram of component (a) is within the range of from 0.1 to 500 LU, the effect of the enzyme (b) is sufficiently exhibited and the detergent composition comprising the lipolytic enzyme (b) in such an amount has a high detergency.

The specific activity, P, of the lipolytic enzyme is determined on the basis of the hydrolysis of triolein (glycerol trioleate) in a pH-stationary state, and is given in terms of the activity per gram of the enzyme. The unit of the specific activity is "LU/g-enzyme". "1 LU/g-enzyme" means that when triolein is hydrolyzed with 1 g of an enzyme, 1 μmol/min of a fatty acid (oleic acid) is produced.

The specific activity, P, of the lipolytic enzyme is determined by hydrolyzing a fatty acid ester with the enzyme at 30° C. and at pH 10.5 by using polyvinyl alcohol (PVA) as the emulsifying agent to produce a fatty acid and dividing the amount (μmol) of the produced fatty acid by time (min) taken for the hydrolysis and the amount (g) of the enzyme used. To effect the hydrolysis at pH 10.5, 50 mmol glycine buffer solution (pH 10.5) is used. The substrate emulsion is prepared by dissolving 18 g of PVA (manufactured by Katayama Chemical Inc.) having a degree of polymerization of 1700 and 2 g of PVA (manufactured by Wako Pure Chemical Industries, Ltd.) having a degree of polymerization of 500 in 1000 ml of distilled water to give a 2% by weight aqueous PVA solution, adding 1.0 g of triolein (manufactured by SIGMA) to 10 ml of the 2% by weight aqueous PVA solution to give a mixture, and emulsifying the resulting mixture by means of a homogenizer for at least 5 min. The enzyme activity is determined with a high performance liquid chromatography according to the method of Y. Kondoh and S. Takano [see Analytical Chemistry, Vol. 58, p.p. 2380–2383 (1986)].

Specially, the enzyme activity is determined as follows, and the specific activity is calculated as follows.

<Method for Calculating the Specific Activity>

(1) Preparation of Calibration Curve

A calibration curve is prepared by taking the amount (nmol) of 1-monoolein (1-MO, manufactured by SIGMA) as the abscissae and peak area as the ordinates.

(2) Determination of LU

The composition of the reaction mixture to be used in the determination of LU is as follows:

lipolytic enzyme solution [which is prepared by dissolving a predetermined amount of the enzyme in 50 mmol glycine buffer solution (pH 10.5)] 1.5 ml substrate emulsion [which is prepared as described above] 1.0 ml The substrate emulsion is added to the lipolytic enzyme solution, and the resultant mixture is stirred by a predetermined mechanical power to conduct the reaction at 30° C. for 30 min. Then, 0.5 ml of a reagent for stopping the reaction [10% by weight solution of sodium dodecylsulfate (manufactured by Wako Pure Chemical Industries, Ltd.) in 50% by volume ethanol (manufactured by Wako Pure Chemical Industries, Ltd.)] is added to the reaction mixture. The resultant mixture is heated on a water bath at 100° C., while introducing nitrogen gas into the reaction vessel, to thereby remove the solvent. 5.0 ml of acetone (manufactured by Wako Pure Chemical Industries, Ltd.) is added to the residue. The mixture thus obtained is thoroughly stirred to dissolve the residue. Then, the resulting mixture is filtrated. 30 μl of the filtrate is applied on a high performance liquid chromatography and analyzed. Each of the peak areas of diolein (DO), monoolein (MO) and glycerol (GLY) is calculated, and then the amount of each of the components contained in 30 μl of the filtrate is determined from the calibration curve prepared in the above item (1).

(3) Calculation of Specific Activity

On the basis of the amount of each of DO, MO and GLY determined in the above item (2), the sum total of produced fatty acids is determined according to the following formula:

sum total of produced fatty acids (μmol) =

[(amount (nmol) of *DO*) + (amount (nmol) of *MO*) × 2 + (amount (nmol) of *GLY*) × 3] × $10^{-3}$ × 5000 (μl)/30 (μl).

Further, the specific activity is determined from the sum total of produced fatty acids, the reaction time and the amount of the enzyme added according to the following formula:

specific activity, *P* (*LU*/g-enzyme), = sum total of produced fatty acids (μmol)/[amount of enzyme added (g) × reaction time (min)].

The anionic surfactant (c) to be used in the present invention is desirably a linear or branched alkylbenzensulfonate, an alkyl or alkenyl ether sulfate, an alkyl or alkenylsulfate, an olefinsulfonate, an alkanesulfonate, a saturated or unsaturated fatty acid salt, an alkyl or alkenyl ether carboxylate, an α-sulfofatty acid salt, an α-sulfofatty acid ester, an amino-acid-type surfactant, an N-acylamino-acid-type surfactant, an alkyl or alkenyl acidic phosphoric ester, or an alkyl or alkenylphosphoric ester or a salt thereof. Alkylbenzenesulfonates and alkyl or alkenyl ether sulfates are particularly preferably used in the present invention.

The amount of the anionic surfactant incorporated is important in the powdered detergent composition of the present invention. In particular, the detergent composition comprises 1.0 to 7.0% by weight, preferably 3.0 to 5.0% by weight, based on the total weight of the composition, of the anionic surfactant. When the amount of the anionic surfactant is within a range of from 1.0 to 7.0% by weight, the detergency on sebum soil is sufficient to make it possible to obtain the effect desired in the present invention.

In the present invention, an alkaline material (d) is employed. The alkaline material (d) is a component necessary for controlling the pH of the 0.1% by weight aqueous solution of the detergent composition at a pH exceeding 9.0.

Examples of the alkaline materials (d) include alkali metal carbonates and alkali metal silicates. Specific examples thereof include sodium carbonate, sodium hydrogencarbonate, potassium carbonate, potassium hydrogencarbonate, sodium silicate and potassium silicate.

The detergent composition of the present invention comprises alkaline material (d) in an amount of 5 to 35% by weight, preferably 5 to 25% by weight, on the basis of the total weight of the composition. In other words, the alkaline material (d) is used in such an amount that the 0.1% by weight aqueous solution of the powdered detergent composition of the present invention has a pH exceeding 9.0, preferably from above 9.0 to 11.0, still more preferably from 10.0 to 10.6. When the 0.1% by weight aqueous solution of the powdered detergent composition of the present invention has a pH exceeding 9.0, the aqueous solution can be an excellent detergent solution.

The detergent composition for clothes according to the present invention desirably comprises, further, a crystalline aluminosilicate having an average primary particle diameter of 0.1 to 10 μm, such as A-type and X-type zeolites, in an amount of preferably 10 to 60% by weight, still more preferably 20 to 60% by weight, particularly preferably 30 to 50% by weight, based on the total weight of the composition.

The detergent composition for clothes according to the present invention may contain, in addition to the above-described components, a bleaching agent such as sodium percarbonate and sodium perborate mono- or tetrahydrate; a stabilizer for a peroxide such as magnesium silicate; an antiredeposition agent such as sodium polyacrylate, polyethylene glycol and polyvinylpyrrolidone; a porous oil-absorbing carrier such as an amorphous silica compound; an enzyme other than the enzyme according to the present invention, such as protease, cellulase and amylase; an enzyme deactivation inhibitor such as a sulfite; a fluorescent dye (a fluorescent brightener); a colorant; a caking inhibitor; a solubilizer; and/or a fragrance. Since the above-described oil-absorbing carrier can cause a reduction of the solubility of the detergent composition, those described in Japanese Patent Publication-A No. 5-5100 and European Patent No. 593,014 are preferably used when the oil-absorbing carrier is employed.

The powdered detergent composition of the present invention can be produced by the process disclosed in European Patent Publication-A No. 513,824. Specifically, the method comprises feeding powdered components to a Lodige Mixer, adding a nonionic surfactant thereto while stirring the powdered components, granulating the resulting mixture and covering the thus-obtained granules with a water-insoluble fine powder such as zeolites. Further, the disclosures in European Patent Publication Nos. 477,974, 562,628 and 560,395 may be referred to in the production. It is preferred that the enzyme is granulated separately from other components and then dry-blended with a detergent base comprising the components other than the enzyme.

According to the present invention, a detergent composition for clothes, which exhibits a remarkably improved detergency on fatty soils caused by sebum and the like when clothes are washed in an ordinary washing time, can be obtained.

EXAMPLES

The present invention will now be described in more detail with reference to the following examples which should not be considered to limit the scope of the present invention.

(I) Preparation of Cloth Soiled with Sebum (Artificially Soiled Test Cloth)

2 g of the model sebum soil having the following composition was uniformly applied to a cotton cloth having a size of 10 cm×10 cm.

<Model Sebum Soil Composition> cotton seed oil 60% by weight
cholesterol 10% by weight
oleic acid 10% by weight
palmitic acid 10% by weight
liquid and solid paraffins 10% by weight (II) Washing Conditions, Washing Method and Evaluation Method Each of the detergent compositions shown in Table 1 was dissolved in hard water (4° DH) to prepare 1 l of aqueous detergent solution having a concentration of the detergent composition of 0.0833% by weight. Five sheets of the cloths soiled with the sebum (i.e., the artificially soiled test cloths) were added to the aqueous detergent solution and left to stand at 30° C. for 1 hour. Then, the aqueous detergent solution and five sheets of the artificially soiled test cloth were transferred to a Terg-O-Tometer stainless steel beaker, and the beaker was set on the Terg-O-Tometer. The Terg-O-Tometer was operated at a revolution number of 100 rpm at 30° C. for 10 min to wash the cloths. The cloths were rinsed in running water and pressed with an iron, and then subjected to the determination of the reflectivity.

The reflectivities of the original cloth (no washing) and the artificially soiled test cloth before and after washing were determined at 460 nm with a self-recording colorimeter (manufactured by Shimadzu Corporation), and the detergency (%) was calculated according to the following formula:

$$\text{detergency (\%)} = \frac{\left(\begin{array}{c}\text{reflectivity}\\ \text{after washing}\end{array}\right) - \left(\begin{array}{c}\text{reflectivity}\\ \text{before washing}\end{array}\right)}{\left(\begin{array}{c}\text{reflectivity of}\\ \text{original cloth}\end{array}\right) - \left(\begin{array}{c}\text{reflectivity}\\ \text{before washing}\end{array}\right)} \times 100.$$

The average of the detergencies each of which was determined and calculated with each of the five sheets of the artificially soiled test cloths is shown in Table 1.

The aqueous detergent solutions each having a concentration of the detergent composition used in this Example of 0.1% by weight had each a pH of 10.6.

What we claim is:

1. A powdered detergent composition comprising (a) a polyoxyethylene alkyl ether, wherein the alkyl group has 10 to 20 carbon atoms on the average and the average molar number of ethylene oxide added is 5 to 15, in an amount of 12 to 35% by weight based on the total weight of the composition, (b) a lipolytic enzyme in such an amount that the lipolytic activity per gram of component (a) would be 0.1 to 500 LU, (c) an sodium linear alkyl ($C_{12}$ to $C_{16}$) benzenesulfonate in an amount of 1.0 to 7.0% by weight based on the total weight of the composition and (d) an alkaline material in an amount of 5 to 35% by weight based on the total weight of the composition, wherein a 0.1% by weight aqueous solution of the composition has a Ph exceeding 9.0.

2. The powdered detergent composition according to claim 1, which further comprises a crystalline aluminosilicate having an average primary particle diameter of 0.1 to 10 μm in an amount of 10 to 60% by weight based on the total weight of the composition.

TABLE 1 unit: % by weight

| | Invention product | | | | | | | | Comparative product | | | | | | | |
|---|---|---|---|---|---|---|---|---|---|---|---|---|---|---|---|---|
| Composition | 1 | 2 | 3 | 4 | 5 | 6 | 7 | 8 | 9 | 10 | 11 | 12 | 13 | 14 | 15 | 16 |
| Lipase A(1) | 2 | 0 | 0 | 1 | 5 | 2 | 2 | 2 | 0 | 0 | 0 | 2 | 0 | 2 | 2 | 2 |
| Lipase B(2) | 0 | 2 | 0 | 0 | 0 | 0 | 0 | 0 | 0 | 0 | 0 | 0 | 2 | 0 | 0 | 0 |
| Lipase C(3) | 0 | 0 | 2 | 0 | 0 | 0 | 0 | 0 | 0 | 0 | 0 | 0 | 0 | 0 | 0 | 0 |
| Nonionic surfactant(4) | 25 | 25 | 25 | 25 | 25 | 15 | 35 | 25 | 25 | 15 | 35 | 0 | 25 | 25 | 25 | 0 |
| Anionic surfactant(5) | 5 | 5 | 5 | 5 | 3 | 5 | 5 | 5 | 5 | 5 | 5 | 25 | 0 | 0 | 10 | 10 |
| Soap(6) | 0.6 | 0.6 | 0.6 | 0.6 | 0.6 | 0.6 | 0.6 | 0.6 | 0.6 | 0.6 | 0.6 | 0.6 | 0.6 | 0.6 | 0.6 | 0.6 |
| Zeolite(7) | 10 | 10 | 10 | 10 | 5 | 10 | 0 | 30 | 10 | 10 | 10 | 10 | 10 | 10 | 0 | 30 |
| Sodium carbonate | 25 | 25 | 25 | 25 | 25 | 25 | 25 | 25 | 25 | 25 | 25 | 25 | 25 | 25 | 25 | 25 |
| Oil-absorbing carrier(8) | 10 | 10 | 10 | 10 | 10 | 7 | 15 | 7 | 10 | 7 | 15 | 0 | 10 | 10 | 10 | 10 |
| Polyethylene glycol(9) | 1 | 1 | 1 | 1 | 1 | 1 | 1 | 1 | 1 | 1 | 1 | 1 | 1 | 1 | 1 | 1 |
| Sodium polyacrylate(10) | 2 | 2 | 2 | 2 | 2 | 2 | 2 | 2 | 2 | 2 | 2 | 2 | 2 | 2 | 2 | 2 |
| Fluorescent brightener(11) | 6.3 | 0.3 | 0.3 | 0.3 | 0.3 | 0.3 | 0.3 | 0.3 | 0.3 | 0.3 | 0.3 | 0.3 | 0.3 | 0.3 | 0.3 | 0.3 |
| Fragrance | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 |
| Sodium sulfate | balance | | | | | | | | balance | | | | | | | |
| Total | 100 | 100 | 100 | 100 | 100 | 100 | 100 | 100 | 100 | 100 | 100 | 100 | 100 | 100 | 100 | 100 |
| Deterging rate (%) | 70 | 68 | 68 | 66 | 75 | 70 | 72 | 78 | 60 | 55 | 62 | 50 | 60 | 61 | 61 | 58 |

Notes)

(1)LIPOLASE 100T (registered trade name, manufactured by Novo Nordisk Bioindustry Ltd.), specific activity: 150 LU/g-enzyme.

(2)LIPOMAX (registered trade name, manufactured by GIST Brocade), specific activity: 1700 LU/g-enzyme.

(3)LUMAFAST 2000G (registered trade name, manufactured by GENENCOR International Inc.), specific activity: 80 LU/g-enzyme.

The specific activities of the above lipases were determined by the above-described method.

(4)polyoxyethylene dodecyl ether, average molar number of ethylene oxide added: 8, carbon atom number of the alkyl group: 12.

(5)sodium linear alkyl($C_{12}$ to $C_{16}$)benzenesulfonate.

(6)carbon atom number: 12 to 14, degree of neutralization: 100%.

(7)A-type synthetic zeolite, average particle diameter: 5 μm.

(8)TIXOLEX 25 (registered trade name, manufactured by Kanfutsu Chemical K.K.).

(9)weight average molecular weight: 8,000.

(10)weight average molecular weight: 13,000.

(11)a mixture of "Tinopal CBS" and "Tinopal DMS-X, P, E" (registered trade names, products of Ciba-Geigy) in a weight ratio of 1/1.

(III) Results

It is apparent from Table 1 that sebum soil can be efficiently removed by washing with the detergent composition of the present invention comprising components (a) to (d) in relative amounts specified in the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

3. The powdered detergent composition according to claim 1, wherein the amount of the alkylbenzenesulfonate is 3.0 to 5.0% by weight based on the total weight of the composition.

4. The powdered detergent composition according to claim 3, wherein the amount of the alkylbenzenesulfonate is 5.0% by weight based on the total weight of the composition.

* * * * *